United States Patent [19]

Nagai et al.

[11] 4,069,859

[45] Jan. 24, 1978

[54] DIRECT POURING METHOD USING SELF-FLUXING HEAT-RESISTANT SHEETS

[75] Inventors: Susumu Nagai; Nobutaka Kanamori, both of Tokyo; Yasuo Sawayanagi, Yokohama; Takashi Nakagawa, Chigasaki, all of Japan

[73] Assignee: Sato Technical Research Laboratory Ltd., Fujisawa, Japan

[21] Appl. No.: 660,816

[22] Filed: Feb. 24, 1976

[30] Foreign Application Priority Data

| | | |
|---|---|---|
| Mar. 3, 1975 | Japan | 50-26330 |
| Mar. 3, 1975 | Japan | 50-26331 |
| Feb. 7, 1976 | Japan | 51-12519 |

[51] Int. Cl.[2] ..... B22D 27/20

[52] U.S. Cl. ..... 164/56; 164/123; 249/206

[58] Field of Search ..... 164/123, 55, 56; 249/206; 106/38.22; 148/23

[56] References Cited

U.S. PATENT DOCUMENTS

| | | | |
|---|---|---|---|
| 3,262,165 | 7/1966 | Ingham | 106/38.22 |
| 3,804,701 | 4/1974 | Bogror | 106/38.22 X |
| 3,920,063 | 11/1975 | Sasaki et al. | 164/123 X |
| 3,942,580 | 3/1976 | Hazlehurst | 249/206 X |
| 3,951,201 | 4/1976 | Dunhem et al. | 164/123 |
| 4,014,704 | 3/1977 | Miller | 164/123 X |

FOREIGN PATENT DOCUMENTS

| | | | |
|---|---|---|---|
| 46-22340 | 1971 | Japan | 106/38.22 |

*Primary Examiner*—Ronald J. Shore

*Attorney, Agent, or Firm*—Stevens, Davis, Miller & Mosher

[57] ABSTRACT

In direct pouring of molten metal for an ingot-making process, hollow long bodies made from self-fluxing heat-resistant sheets are used as a splash-preventive pipe. The self-fluxing heat-resistant sheet is composed of one or more inorganic fibers having fixed softening and fusion temperatures, binders and silicate fillers. The fusion rate and temperature of the sheet are selected in accordance with the teeming rate and temperature to insure that the body end is fused and consumed while being submerged in a given depth below the molten metal surface in a mold.

25 Claims, 32 Drawing Figures

DIRECT POURING METHOD USING SELF-FLUXING HEAT-RESISTANT SHEETS

The present invention relates to an improvement on the direct pouring method of ingot-making processes and hollow long bodies made from self-fluxing heat-resistant sheets applied to the method.

As is well-known, teeming of ferrous and nonferrous metals in ingot molds is accomplished by direct pouring or bottom pouring. In general, direct pouring is more economical compared to bottom pouring and further makes it possible to reduce such internal defects as entrapped nonmetallic inclusions produced by erosion, of the funnel, fountain and runner brick used in a bottom-pour assembly. In direct pouring, however, occurrence of ingot surface defects is severe. This increases the need for scarfing, planing or grinding of ingots and semi-finished products and often results in a higher production cost than when using bottom pouring.

It is well-known that ingot surface defects in direct pouring are mainly caused by occurrence of splashes in the mold. The inventors have paid special attention to the differences of molten metal flow occurring in the mold during direct pouring and bottom pouring. Thereby, it has been confirmed that the occurrence of surface defects can additionally be related to the state of the molten metal flow in the vicinity of the convex meniscus formed on the molten metal surface adjacent to the mold wall.

The molten metal flow in the mold during bottom and direct pouring is illustrated in FIGS. 1 and 2. In bottom pouring, as shown in FIG. 1, molten metal 3 enters the bottom of the mold 9, through a runner brick 10. In this case, the molten metal surface 1, rises quietly in the mold 9 and growth of a solidified shell 2, follows. The hot molten metal 3, however, can always flow just below the convex meniscus of the molten metal surface adjacent to the mold wall in the direction of the arrows. The thin solidified layer formed along the convex meniscus, i.e. meniscus shell 4, is forced to straighten and flatten against the mold wall by the increasing static pressure caused by rise of the molten metal surface, and thus results in formation of an ingot skin. Consequently, bottom pouring can be characterized by a steady rise of the molten metal surface and by constant hot metal flow just below the meniscus shell. Under these conditions, when a suitable casting powder is added on the molten metal surface, a molten slag with a favorable composition is formed, covering the entire molten metal surface in the mold. The molten slag dissolves such floating matter as inclusions and oxide films and always keeps the meniscus shell clean. This effectively prevents ingot surface defects. In other words, superior ingot surface quality obtained in bottom pouring can be associated with the favorable hot metal flow just below the meniscus shell and with the use of suitable castings powders. In FIG. 1, the numeral 11 represents a stool.

In direct pouring, as shown in FIG. 2, a high-speed pouring stream 8, with high ferrostatic head falls directly onto the molten metal surface 1, in the mold 9, and causes splashes 7. Such splashes form metal patches adhered to and solidified on the inner walls of the mold. Furthermore, the molten metal falling onto the molten metal surface causes surface undulation and horizontally turbulent flow toward the inner wall of the mold as shown by the arrows. This can be associated with irregular variation of the meniscus shape and partial breakage of the meniscus shell 4. Ingot surface defects are caused not only by the presence of the solidified metal patches but also by partial breakage of the meniscus shell. Addition of any casting powder onto such turbulent molten metal surface, may only cause an increase of skin inclusions and hardly reduces ingot surface defects. In other words, occurrence of ingot surface defects in direct pouring can be related not only to splashes, but also to unfavorable turbulent molten metal flow in the vicinity of the meniscus shell, and additionally, to difficulties of successful powder casting.

Considering the above mentioned, it is necessary for the economical production of sound ingots by direct pouring, with substantially the same surface quality as that of bottom poured ingots, to satisfy the following requirements.

1. The formation of splashes against the mold wall must be prevented.
2. The occurrence of horizontally turbulent flow must be prevented; a favorable steady flow just beneath the meniscus shell as in bottom pouring must be formed.
3. Powder casting must be successfully applicable.

If these requirements can be met in direct pouring, the ingot-making cost is largely reduced, the product yield is considerably improved and, in some cases, an automatic teeming operation may become possible.

In connection with these problems, many improvements of the direct pouring method have hitherto been proposed and can be divided into the following five categories:

A. Methods using molds lined with paperboard or glass fiber sheet, the voids of which are filled with powdered carbon, metal, refractories or the like (Japanese Patent Application Publication No. 6,607/59, No. 10,115/60 and No. 4,706/61).

B. Methods using a short cylindrical body fixed or placed on the mold bottom and pouring an initial stream thereinto (Japanese Patent Application Publication No. 4,313/63, No. 42,305/71 and No. 28,533/73), or Methods placing various shaped shock-absorbing bodies on the mold bottom to absorb shocks caused by the initial pouring stream (Japanese Patent Application Publication No. 22,167/66). In the former methods, steel plate, wire gauze, paperboard coated with inorganic substances, fiber board and the like are used as a material for the cylindrical body. In the latter methods, paperboard, fiber board, wood plate, metal plate and the like are used in a form of cone, pyramid, short cylinder, corrugated plate and the like.

C. Methods using a thin steel cylinder suspended in a mold as a so-called splash-preventive pipe extending above the mold height (Japanese Patent Application Publication No. 6,967/67).

D. Methods using a long refractory pipe mounted on the ladle nozzle extending to the mold bottom, and pouring molten metal, while lifting the ladle so as to keep the pipe end submerged in the molten metal (Japanese Patent Application Publication No. 4,306/63).

E. Methods using a short cylindrical body of refractories or similar material floating on the molten metal surface in the mold and pouring the molten metal therethrough: Methods using a floating cylindrical body with outer coating of a casting powder or a floating cylindrical body rising along metal pipe guides filled with a casting powder.

Of the above mentioned methods, methods A and B can only prevent direct adhesion of metal patches to the mold wall but cannot prevent occurrence of surface defects, and use of a casting powder is difficult. Furthermore, if the floating, burning and fusion of the lining material, cylindrical body, shock-absorber and the like are not completed, possible internal defects result.

In methods C, the cylinder of steel plate is practically used with casting powders. In this method, however, fusion and diffusion of the steel plate, must be completed during teeming and solidification. In other words, the application of this method must be limited to steel grades having temperatures equal to or higher than that of the steel plate.

Methods D are reasonable in principle. Casting powders may successfully be used. However, this method has not yet been in practical use because the extended refractory pipe is often broken and control of the ladle lifting rate is rather difficult. In methods E, there are many practical problems and it is difficult to perform effective powder casting.

The inventors have aimed at the methods belonging to the above mentioned category C and made various studies with respect to a method using a hollow long body made from heat-resistant sheets mainly composed of inorganic fibers instead of steel plates.

Hitherto, there have been many well-known heat-resistant, non-combustible or electrical insulating sheets consisting mainly of glass fiber, rock wool, slag wool and the like. These sheets, however, usually having fusion temperatures lower than 800° C and , cannot be used with higher temperatures. The teeming temperature in direct pouring is generally higher than 800° . When applying such a heat-resistant sheet to direct pouring, it is necessary to control certain physical and chemical properties of the sheet; such as mechanical strength when heating from room temperature to application temperatures, softening and fusion temperatures, softening and fusion rates, wettability against molten slag and metal; chemical composition as a fused flux, etc., in accordance with given conditions. In the so-called heat-resistant sheets hitherto used, however, the physical properties and chemical composition in the molten state have never been taken into consideration.

The inventors have made various investigations with respect to such heat-resistant sheets composed mainly of inorganic fibers which can provide the sheets with the necessary properties and compositions in a molten state for use in direct pouring. As a result of the investigations, the inventors found that the "self-fluxing heat-resistant sheets", as mentioned below in detail can successfully be used as a splash-preventive pipe for direct pouring; these sheets having controlled fusion temperatures greater than 800° C are fused and consumed in accordance with a given teeming temperature and rate and act as a flux in the molten state.

It has been found that when a hollow long body made from the above "self-fluxing heat-resistant sheet" is used as a splash-preventive pipe for direct pouring, the aforementioned requirements, i.e. (1) prevention of splashes, (2) favorable flow of molten metal in the vicinity of meniscus, and (3) successful use of a casting powder, can be satisfied and superior ingot surface quality nearly equal to that of bottom poured ingots can be obtained. Furthermore, it has been confirmed that use of such self-fluxing heat-resistant sheets easily makes it possible, to adapt direct pouring for ingot-making of various ferrous and non-ferrous metals.

Consequently, the present invention provides a method of directly pouring molten metal into a mold to make a metal ingot characterized by the following: A hollow long body made of the above mentioned self-fluxing heat-resistant sheet is fixed on the mold top and suspended in the mold to reach the mold bottom; a suitable casting powder is placed on the mold bottom outside the hollow long body; the molten metal is poured from the mold top through the hollow long body; the softening and fusion temperatures and rates of the hollow long body are so suitably controlled that its end is fused and consumed while bing submerged in a given depth below the molten metal surface during teeming.

The term "hollow long body" used herein includes those with round or oval sections, rectangular sections, concave rectangular sections and the like. The term "self-fluxing heat-resistant sheet" used herein means sheets which have a softening fusion temperature greater than 800° C and are fused and consumed at a given temperature in compliance with the teeming rate and temperature of molten metal.

The self-fluxing heat-resistant sheet to be used in the present invention is composed of one or more inorganic fibers having fixed softening and fusion temperatures, binders and silicate fillers. First, these basic materials are formed into a sheet with a thickness of 0.2–5 mm by means of a paper-making machine, a non-woven fabric forming machine, a molded pulp machine and the like.

When the self-fluxing heat-resistant sheet is shaped into a hollow long body, one or more flat sheets and/or corrugated sheets are lapped. A metal foil or thin sheet of 0.02–1 mm thickness is stick to one or both sides of the flat sheet or corrugated sheet and the resulting assembly is subsequently shaped into a hollow long body.

According to the present invention, the hollow long body made from the self-fluxing heat-resistant sheet is suspended in a mold for direct pouring. In this case, the fusion rate and temperature of the sheet are selected in accordance with the teeming rate and temperature to insure that the body end is fused and consumed while being submerged in a given depth below the molten metal surface in the mold. Therefore, if the teeming temperature is the same, under the higher teeming rate, a sheet with a lower fusion temperature can be used. Moreover, the fusion rate of the hollow long body may be adjusted by the lap number of thickness of the sheet.

The present invention will be described in greater detail with reference to the attached diagrams, wherein.

According to the present invention, the self-fluxing heat-resistant sheet suitable for direct pouring as a splash-preventive pipe consists of 50–90% by weight of one or more of inorganic fibers having given softening and fusion temperatures, 1–10% by weight of a binder and 10–50% by weight of a silicate filler.

For the present invention, three types of inorganic fibers are used; fibers with fusion temperatures greater than 1,300° C such as ceramic fiber, silicate fiber, boron fiber, carbon fiber and the like (called "high-temperature-fusible fibers" in the following; fibers with fusion temperatures of 1,100°–1,300° C such as rock wool, slag wool and the like ("medium-temperature-fusible fibers"); fibers with fusion temperatures of 800° C–1,100° C such as glass fiber, asbestos fiber and the like ("low-temperature-fusible fibers").

Figure 3:
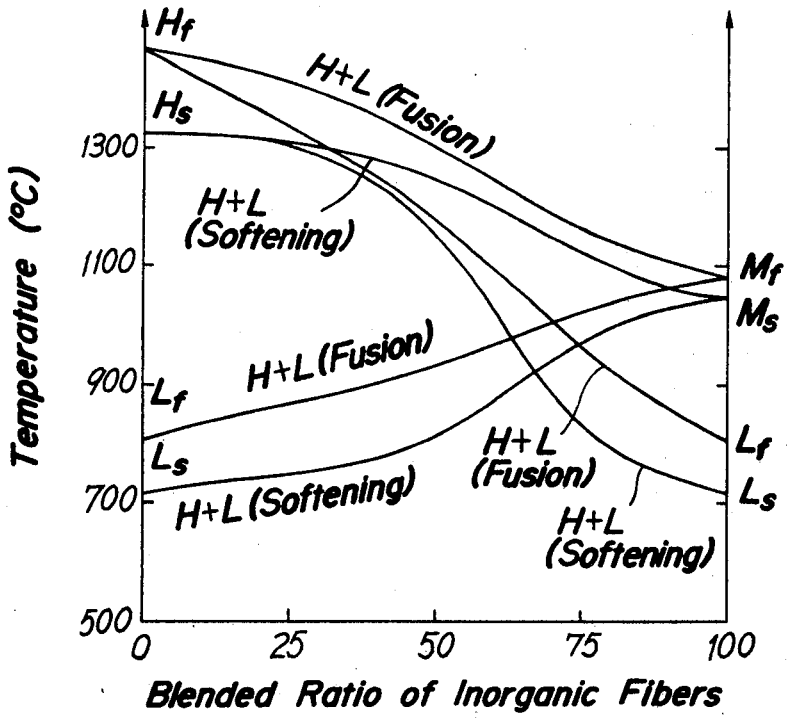
FIG. 3 is a graph showing the relations between a blended ratio of various inorganic fibers and the softening and fusion temperatures in a self-fluxing heat-resistant sheet according to the present invention.

These inorganic fibers are used in an optional combination in compliance with teeming conditions given to the hollow long body of the sheet, particularly teeming temperatures of molten metal. For instance, with teeming temperatures rather higher than 1,200° C, according to FIG. 3, a combination of 40% by weight of the "high-temperature-fusible fiber" and 60% by weight of the "medium-temperature-fusible fiber" or a combination of 60% by weight of the "high-temperature-fusible fiber" and 40% by weight of the "low-temperature-fusible fiber" can be used. In FIG. 3 showing relations between blended ratio of inorganic fibers and softening and fusion temperatures, Hf and Hs are fusion and softening temperatures of the "high-temperature-fusible fiber", respectively; Mf and Ms fusion and softening temperatures of the "medium-temperature-fusible fibers"; Lf and Ls the respective temperatures of the "low-temperature-fusible fibers". It is obvious from FIG. 3 that a combination of inorganic fibers with different softening and fusion temperatures can be optionally selected in compliance with teeming conditions.

In the present invention, these inorganic fibers must necessarily be formed into a sheet by a paper-making macine, a non-woven fabric forming machine, a molded pulp machine or the like. However, a sheet composed only of inorganic fibers cannot be provided with sufficient mechanical strength for practical use. In order to increase mechanical strength, some binders are used for mutual bonding of the inorganic fibers. Binders include starch, PVA resin, acrylic resin, epoxy resin, urea resin, phenolic resin, vinyl acetate resin and other synthetic resins.

The binder can be added before or after sheet formation. In the former case, the binder is mixed with blended fiber in the form of latex, emulsion, aqueous solution, powder, fiber or the like. In the latter case, the binder is added to the formed sheet by spraying, impregnating, coating or a combination of them, after sheet formation. It is particularly preferable to add the binder in the form of an emulsion or fiber before sheet formation.

In the self-fluxing heat-resistant sheet according to the present invention, the silicate filler occupies voids between the fibers. This can contribute to the mutual bonding of the inorganic fibers at higher temperatures and give suitable flux composition after fusion of the sheet. The silicate filler must be of extremely fine particles of siliceous materials such as silica flour, kaolin, bentonite, refractory clay, calcium silicate and the like. The addition of the silicate filler can also be made before or after the sheet formation. In the former case, fine silicate particles are dispersed in a mixture of the inorganic fiber and the binder before sheet formation, and in the latter, fine silicate particles are applied to the sheet in a suspended state by spraying, impregnating, coating or the like after sheet formation. It has been found from experiments that the latter method is preferable.

According to the present invention, the inorganic fiber used amounts to 50–90% by weight, preferably 60–80% by weight. Furthermore, the amount of the inorganic fiber used is relevant to the amount of silicate filler added as will be described hereinafter. With the same chemical composition of the sheets, if the amount of inorganic fiber is less than 50% by weight, the amount of filler must be excessively increased, thus resulting in a lowering of the mechanical strength. If the amount of the inorganic fiber exceeds 90% by weight, the allowable amount of filler becomes insufficiently small for providing the sheet with the necessary filling effect and mechanical strength. The respective blended ratio of the "high-temperature-fusible fiber", the "medium-temperature-fusible fiber" and the "low-temperature-fusible fiber" may be optionally selected in compliance with the required properties of the sheet, particularly the softening and fusion temperatures as seen from FIG. 3.

Figure 4:
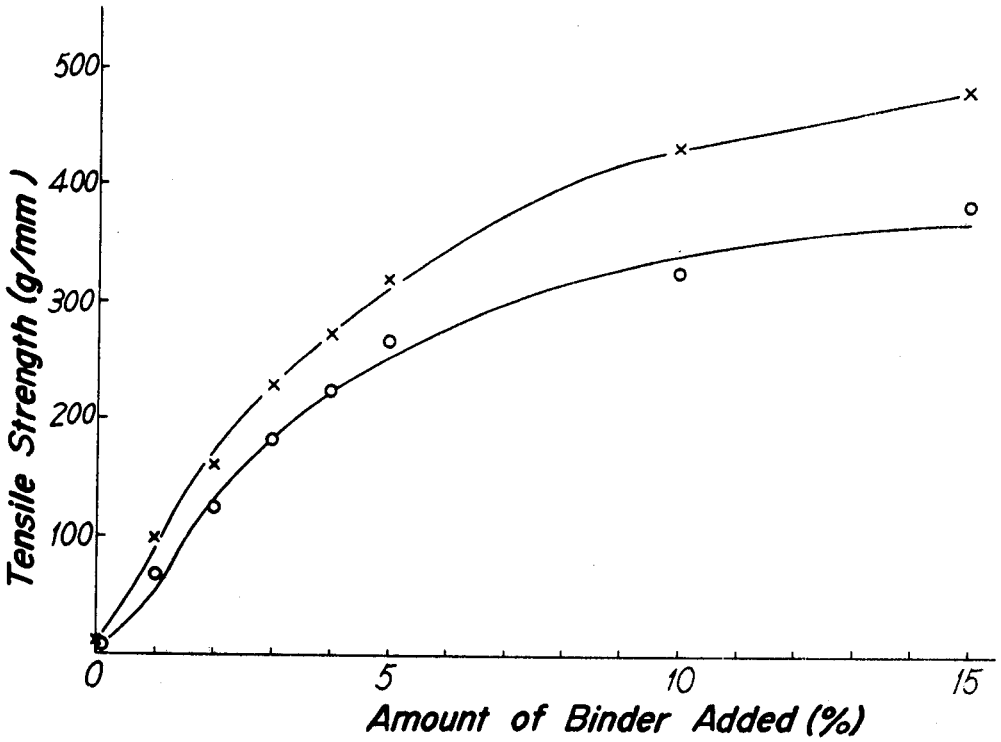
FIG. 4 is a graph showing the relations between addition of an amount of a binder and tensile strength of a self-fluxing heat-resistant sheet according to the present invention.

The amount of binder added is within a range of 1–10% by weight, preferably 2–6% by weight. FIG. 4 shows an example of the relations between the amount of binder added and tensile strength of the resulting sheet, when starch and PVA binder are added to the inorganic fiber in various amounts. In FIG. 4, symbol o represents the addition of starch, and symbol × represents the addition of PVA. If the amount of binder is less than 1% by weight, it becomes very difficult to form the sheet by a paper-making machine and the like. If the amount of binder exceeds 10% by weight, the corresponding increase of tensile strength in the sheet, i.e., the corresponding adding effect cannot be expected. Furthermore, the sheet containing excess binder shows poor heat-resisting properties and is easily disintegrated, burned and smokes at rather low temperatures.

Figure 5:
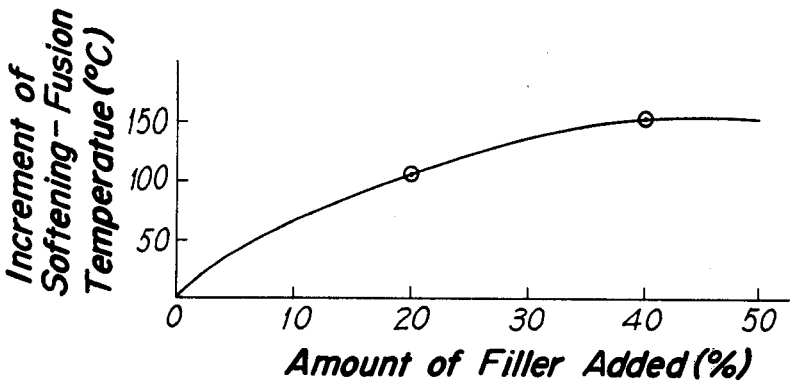
FIG. 5 is a graph showing the relation between addition of an amount of silicate filler and increment of softening-fusion temperature in a self-fluxing heat-resistant sheet according to the present invention.
Figure 6:
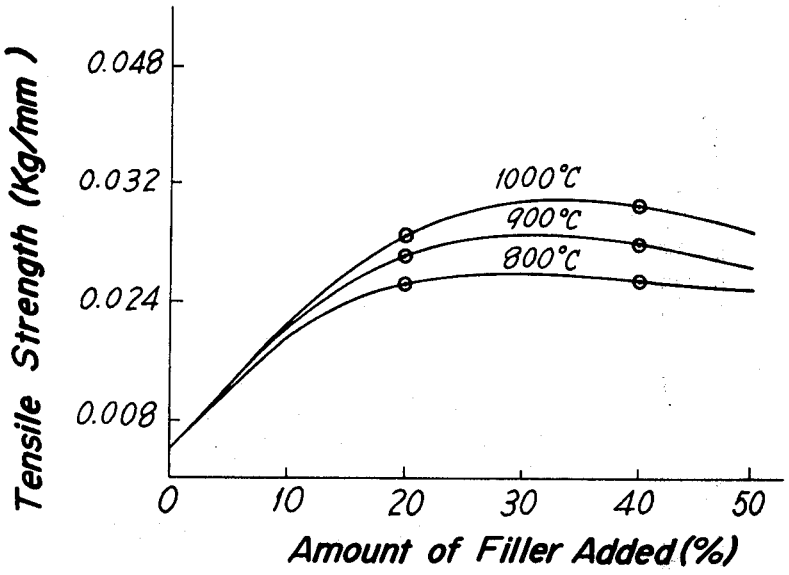
FIG. 6 is a graph showing the relations between addition of an amount of a silicate filler and tensile strength of a self-fluxing heat-resistant sheet according to the present invention.

The amount of silicate filler added is within a range of 10–50% by weight, preferably 20–40% by weight. When the silicate powder is added in various amounts to the inorganic fiber together with the binder, as shown in FIG. 5, the softening and fusion temperatures of the resulting sheet rise with the increase of addition. FIG. 5 shows an increment of softening-fusion temperature of the sheet with respect to the addition of filler. As shown in FIG. 5, an amount of silicate filler less than 10% by weight does not show such effective control for fusion temperature, while an amount exceeding 50% by weight does not show the rise of softening-fusion temperature, i.e., the actual adding effect cannot be realized. Furthermore, FIG. 6 shows the relation between the amount of silicate filler added and tensile strength of the resulting sheet at temperatures of 800° C, 900° C, and 1,000° C. As shown in FIG. 6, an amount less than 10% by weight, lowers tensile strength of the sheet, while an amount exceeding 50% by weight also causes lowering of tensile strength.

According to the present invention, if the sheet is made only from inorganic fibers, mutual entanglement of the fibers is rather difficult. In order to enhance the mutual entanglement, up to 30% by weight of natural or synthetic organic fibers may be added to the inorganic fibers. In this way, the mutual entanglement of the inorganic fibers is improved and, at the same time, adhering tendency is given to the fibers. This leads to an increase in mechanical strength of the resulting sheet. Natural fibers include wood fiber, cotton fiber, cotton yarn and the like. Synthetic organic fibers include polyethylene fiber, polypropylene fiber, vinylon fiber, nylon fiber, acrylic fiber, polyester fiber rayon fiber and the like.

Figure 7:
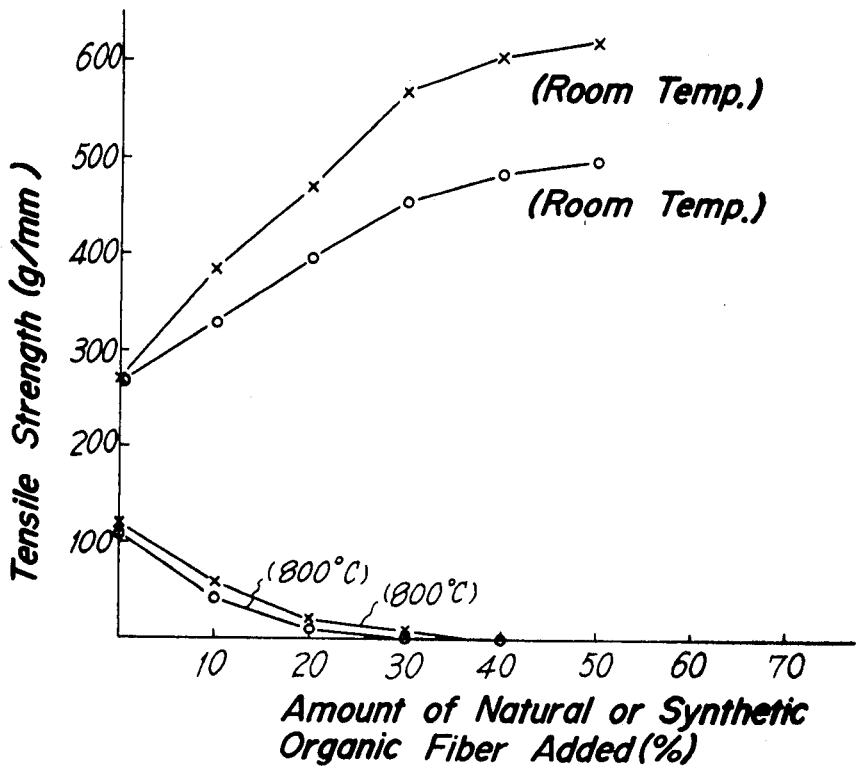
FIG. 7 is a graph showing the relations between addition of an amount of a natural or synthethic organic fiber and tensile strength of a self-fluxing heat-resistant sheet according to the present invention.

When natural or synthetic organic fibers are added in various amounts to a mixture of inorganic fibers and a binder of 4% by weight, to form a sheet, as shown in FIG. 7, the room temperature strength of the sheet increases with increase of the addition amount. The strength at 800° C gradually decreases with an increase of the addition amount and becomes zero at 30% by weight, resulting in lowering the heat-resisting properties. Therefore, the addition amount of the natural or synthetic organic fiber should be at most 30% by weight, preferably 5–20% by weight. In FIG. 7, symbol o represents the addition of vinylon fiber as the synthetic organic fiber, and symbol × represents the addition of wood fiber as the natural fiber.

Moreover, when the self-fluxing heat-resistant sheet, according to the present invention, is composed of inorganic fibers or of inorganic fibers and natural or synthetic organic fibers, the mechanical strength of the sheet is insufficient under some conditions. In this case, metallic fibers such as iron, aluminum, stainless steel, copper and the like may be added to improve the mechanical strength of the sheet. In addition, a wire, net, foil or thin sheet of these metals may be incorporated during sheet formation or may be mounted or laminated after sheet formation.

Figure 8:
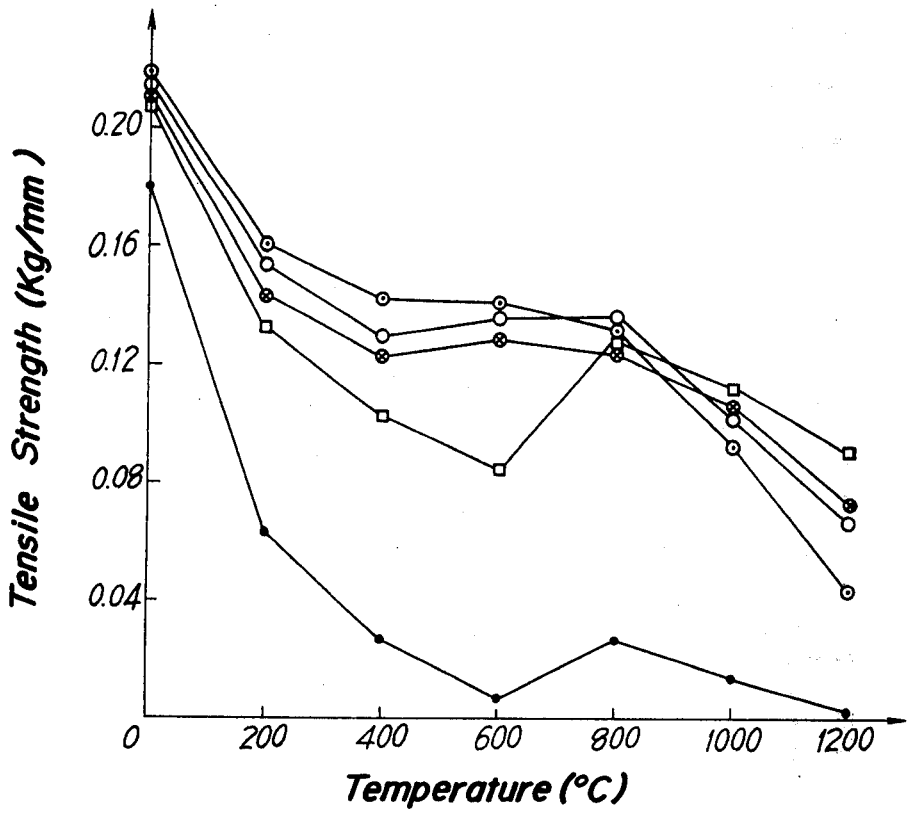
FIG. 8 is a graph showing the relations between temperature and tensile strength for several kinds of impregnants in a self-fluxing heat-resistant sheet according to the present invention.

The self-fluxing heat-resistant sheet composed only of inorganic fibers and binder has a minimum value of tensile strength in a temperature range of from 200° C to 800° C as shown by symbol ● in FIG. 8. By adding 30% by weight of the silicate filler to this sheet, the minimum value of tensile strength increases as shown by symbol □ and the mechanical strength of the sheet is improved. This is due to the fact that the filler prevents preferential decomposition of the binder and causes mutual bonding of the fibers in its partial fusion. Even in this curve, however, the minimum value between 200° C and 800° C still remains. Therefore, further improvement of the minimum tensile strength value is necessary under a certain condition for use. For this purpose, the following impregnants may be added to the self-fluxing heat-resistant sheet according to the present invention: Alkali and alkaline earth salts, for example, sodium, potassium, magnesium, barium salts and the like; metal oxides, for example, magnesium, titanium oxides and the like; phosphates and the like. This can effectively decrease tensile strength in the temperature range of 200°–800° C. The amount of impregnant added is at most 10% by weight, preferably 3–6% by weight. FIG. 8 further shows dependencies of tensile strength on temperature for the sheets when various amounts of alkali salt (sodium silicate) is impregnated with the sheet composed of the inorganic fibers, the binder and the filler with symbols ⊛(1%), o (4%) and ⊙ (7%). It is obvious from FIG. 8 that the addition of impregnant minimizes tensile strength decrease in the above mentioned temperature range but causes considerable lowering of the tensile strength at a temperature above 1,000° C. Therefore, the amount of impregnant added is limited to up to 10% by weight.

In order to accelerate deoxidation of molten metal, powdered metal such as aluminum, ferrosilicon, calcium silicon, magnesium, ferromanganese and the like may be added as a part of the filler.

Furthermore, the self-fluxing heat-resistant sheet may be subjected to the following treatment to decrease the "wettability" against molten slag and metal or to lower the apparent fusion rate of the sheet having a fixed fusion point:

The sheet is immersed in a suspension of fine carbonaceous particles such as carbon black and the like containing the binder or in liquefied tar or asphalt to form a layer impregnated with carbonaceous particle or heavy hydrocarbon. The nature of the chemical bond in carbonaceous substances is substantially different from both the ionic bond in the sheet and its molten slag and metallic bond in molten metal. The impregnation of carbonaceous particles, therefore, effectively reduces the wettability against molten slag and metal and prevents agglomeration of the liquid particles during fusion, whereby the fusion rate of the sheet is considerably lowered.

Fusion temperatures of the self-fluxing heat-resistant sheet according to the present invention are considerably higher than those of conventional heat-resistant sheets, and within a range of 800° C to 1,450° C. Those can easily be adjusted by the blended ratio of inorganic fibers and amount of silicate filler added.

According to the present invention, the self-fluxing heat-resistant sheet is made from inorganic fibers, binders and silicate fillers, if necessary, together with other additives by conventional paper-making machines, nonwoven fabric forming machines, molded pulp machines and the like. The sheet is provided with suitable flux composition to cover molten metal surfaces, sufficient mechanical strength from room temperature to application temperatures for direct pouring use and has a thickness of 0.2–5 mm.

The sheet can easily be shaped from a single sheet or lapped and wound sheets or laminated sheets into a fixed hollow long body by conventional shaping methods.

Figure 9:
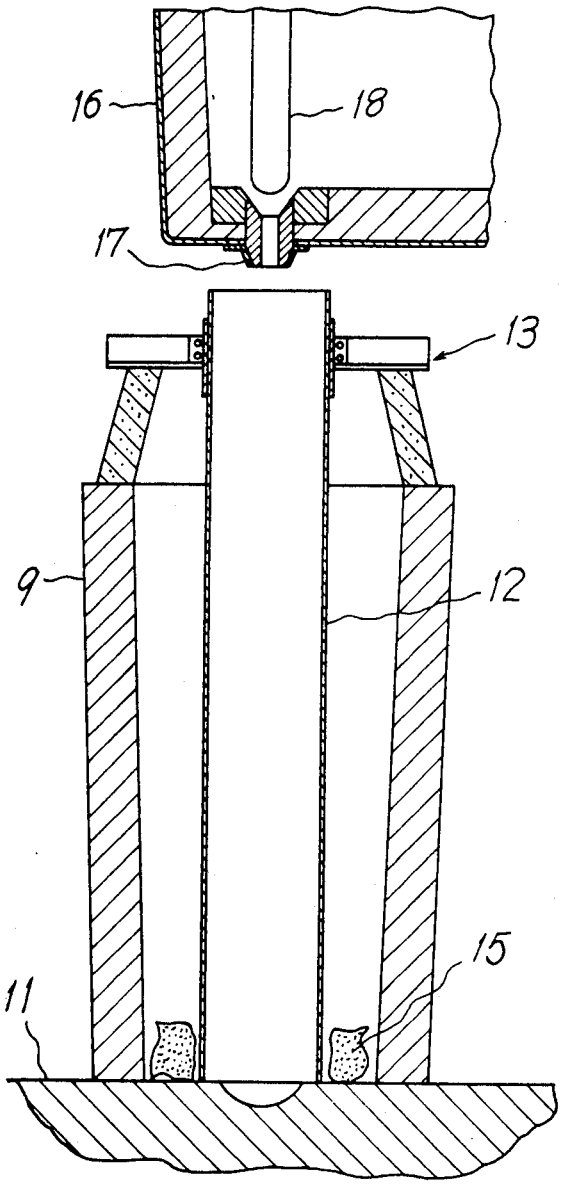
FIG. 9 is a longitudinal cross-section view of an assembly using a hollow cylindrical body of a self-fluxing heat-resistant sheet for direct pouring according to the present invention.

The direct pouring method of the present invention using the hollow cylindrical body made from the self-fluxing heat-resistant sheet will be explained as follows:

As shown in FIG. 9, a cylinder, of a self-fluxing heat-resistant sheets 12, is fixed on the hot-top frame 13, set to the mold top and suspended in the mold 9, so as to reach the mold bottom. In the mold 9, a casting powder with a slag composition selected for the teeming conditions of given metal grades is placed on stool 11, outside the cylinder 12. Then, molten metal 3 is poured into the mold from the ladle 16, through the nozzle 17, and the cylinder 12. In this diagram, numeral 18, represents the stopper.

Figure 10:
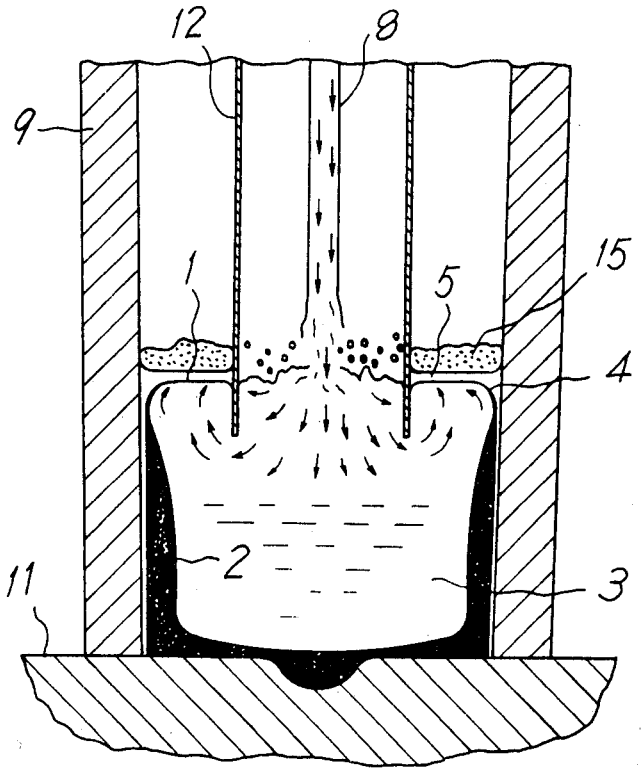
FIG. 10 is a longitudinal cross-section view of a mold during direct pouring according to the present invention, illustrating molten metal flow.

As shown in FIG. 10, the end of the cylinder 12, is fused and consumed in contact with the molten metal bath 3, formed in mold 9. In this event, the molten metal 3 flowing out through cylinder 12 forms a rather steady upward flow along the mold wall as shown by the arrows, while the molten metal surface outside cylinder 12, is completely covered by the casting powder throughout teeming.

By properly selecting a ratio of inner cylinder diameter 12 and outer pouring stream diameter 8, i.e., inner nozzle diameter 17, excessive temperature rise and disintegration of the cylinder can be prevented. Further, the time required for complete fusion of the sheet lengthens with thickness increase or lap number of the sheets. Therefore, fusion time or consumption rate of the cylinder can also be adjusted by lap-winding of a single sheet or by lamination of sheets with the same composition. When cylinder 12 is fused and consumed, however, its melt is combined with molten slag 5, formed by fusion of the casting powder 15. Therefore, if a large amount of the melt of the cylinder is formed during teeming, chemical composition and properties of the powder slag is markedly changed. Under such conditions, the powder casting becomes unsuccessful. Consequently, the amount of the melt formed by fusion of the cylinder should be sufficiently smaller than that of the powder slag. In other words, the thickness of the cylinder should be quite thin. With regard to these conditions, the thickness of the sheet is limited within the range of 0.2–5 mm, preferably 0.5–1.2 mm in the present invention. Further, when forming a cylinder by lap-winding or laminating the said sheets, at most three-layer construction should be adapted to reduce the amount of the melt. When manufacturing the self-fluxing heat-resistant sheet according to the present invention by a conventional paper-making machine and the like, thickness exceeding 5 mm causes a remarkable rise of manufacturing cost. With thicknesses less than 0.2 mm, the manufacturing operation becomes very difficult because of strength loss. Teeming time in direct pouring is usually less than 300 seconds. The fusion time of the sheet, therefore, should be adjusted to within 300 seconds. For this purpose, the thickness of the sheet or the cylinder should also be within 5 mm.

Furthermore, the melt of the self-fluxing heat-resistant sheet floating through the molten metal bath 3, has fluxing action and may promote floating of inclusions. The melt, therefore, is never retained in the ingot.

Figure 1:
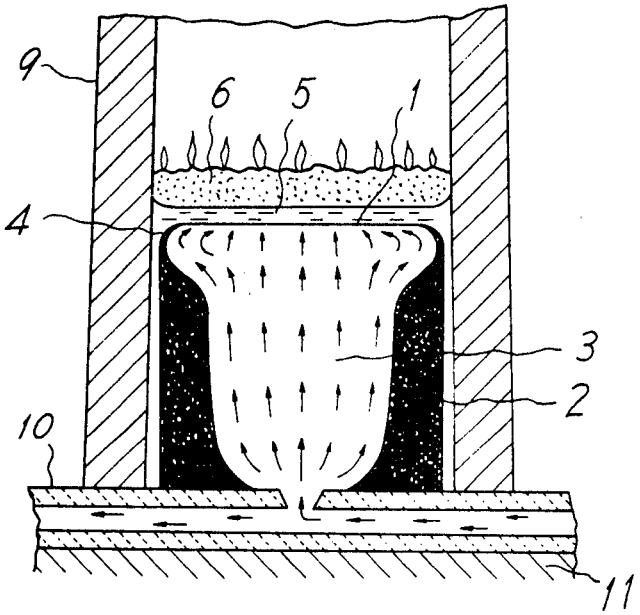
FIG. 1 is a longitudinal cross-section view of a mold during bottom pouring with casting powder, illustrating molten metal flow and meniscus shell formation.

As shown in FIG. 10, the molten metal surface 1, rises steadily even during direct pouring, this results in formation of the stable meniscus shell 4. Since cylinder 12, serves as a splash-preventive pipe during direct pouring, adhesion of splashes to the walls can be completely prevented. Further, the bottom end of cylinder 12, submerged into a given depth below the molten metal surface 1, causes reversed ascending flow of molten metal 3, inside the meniscus shell 4, as shown by the arrows. Thus, the molten metal flow adjacent to the mold wall becomes similar to that during bottom pouring shown in FIG. 1, whereby any occurrence of a turbulent molten metal flow in the vicinity of the meniscus can be effectively prevented. Therefore, the casting powder 15, added to the molten metal surface outside cylinder 12, can effectively prevent ingot surface defects as well as during bottom pouring.

Figure 2:
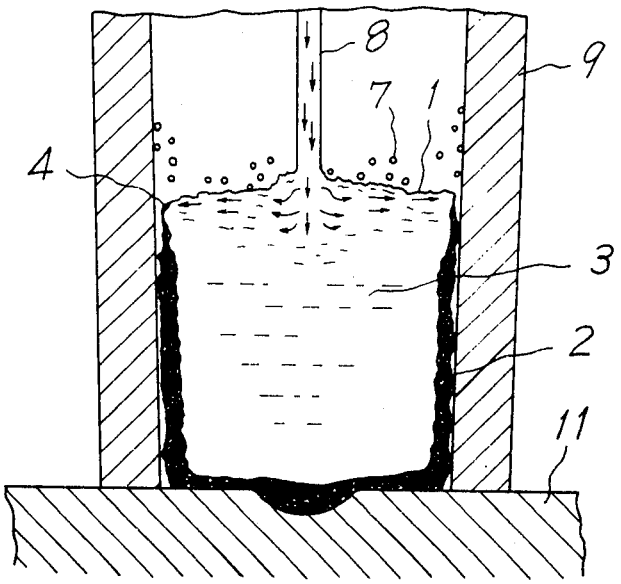
FIG. 2 is a longitudinal cross-section view of a mold during direct pouring, illustrating splashing, turbulent molten metal flow and unsteady shell formation.

The fusion temperature and rate of cylinder 12 are selected in compliance with the teeming temperature and rate so as to realize such a condition that the cylinder end is constantly submerged to a depth of 30–50 mm below the molten metal surface 1. By using the cylinder, unfavorable molten metal flow in the vicinity of the meniscus shell 4 shown in FIG. 2, can be converted into favorable steady flow similar to that in bottom pouring, as shown in FIG. 10. A submersion depth of cylinder 12, less than the above range, may change the molten metal flow in the vicinity of the meniscus shell into an unfavorable turbulent flow. Further, under the same teeming temperature, the higher teeming rate enables the use of a cylinder of the sheet with lower fusion temperature or a less number of lapped sheets. In addition, the distance between the outer surface of the cylinder and the mold wall must necessarily be more than 50 mm, the powder casting cannot be successfull.

Various embodiments of self-fluxing heat-resistant sheets and hollow long bodies made therefrom will be described with reference to the drawings.

Figure 11:
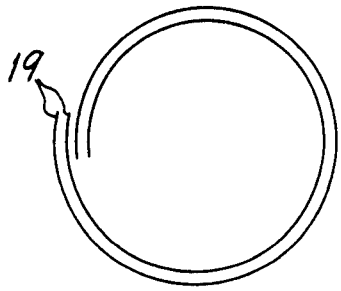
FIGS. 11–30 are transverse cross-section views of embodiments of hollow long bodies made from the self-fluxing heat-resistant sheets according to the prevent invention, respectively.
Figure 12:
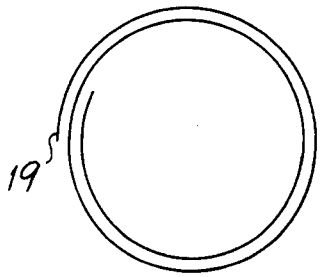
Figure 20:
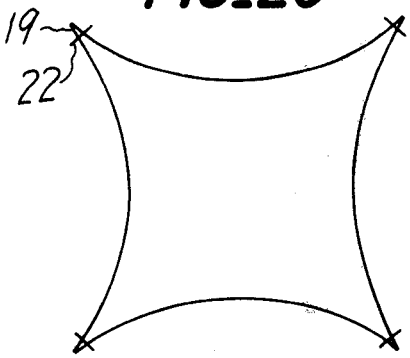
Figure 21:
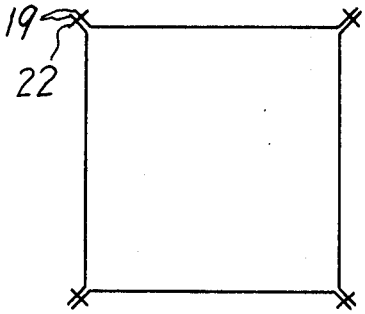
Figure 22:
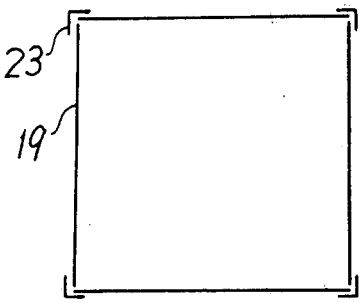
Figure 23:
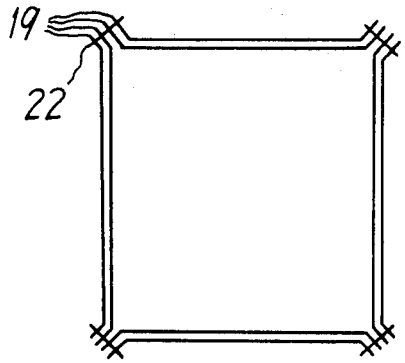

FIGS. 11 and 12 show two embodiments using a flat sheet 19: FIG. 11 shows a hollow cylindrical body formed by lap-winding of two flat sheets 19; FIG. 12 a hollow cylindrical body formed by double rolling of one flat sheet 19. FIGS. 20 to 23 show transverse sectional views of a hollow rectangular body made from the flat sheet 19: FIG. 20 shows a hollow square concave body formed by fixing four flat sheets 19 at both sides with fittings 22; FIG. 22 a hollow rectangular body formed by four flat sheets 19 fixed at both sides with reinforcing fixtures 23; FIG. 21 a hollow rectangular body formed by fixing four flat sheets 19 at both sides folded in a given angle with fittings 22; FIG. 23 a hollow rectangular body formed by fixing four double-layered flat sheet 19 at both sides folded in a given angle with fittings 22.

The thickness and lap-number of the sheets are determined by taking a casting powder amount to be added into consideration. However, under the conditions shown in FIGS. 9 and 10, the hollow long body is subjected to such forces as its dead weight, buoyancy in the molten metal, horizontal vibration load generated by the shock of the pouring stream falling and the like. The inner surface of the hollow long body is rapidly heated by radiant heat emitted from the high-temperature pouring stream during teeming. In order to endure such conditions, the hollow long body must be provided with sufficient high-temperature strength. For this purpose, "modulus of section" values of the hollow long body can be increased by increasing the lap number of the sheets. However, the lap number must not be excessively increased because it leads to an unfavorable increase of the amount of the melt. This becomes critical particularly in a small section mold.

Figure 13:
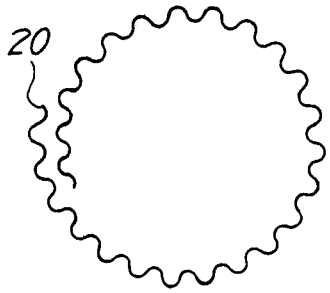
Figure 14:
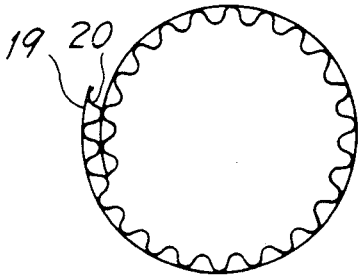
Figure 15:
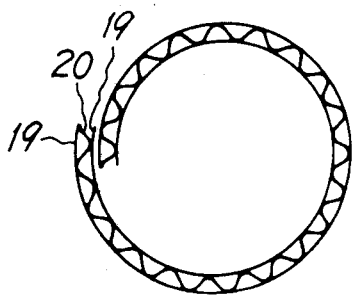
Figure 24:
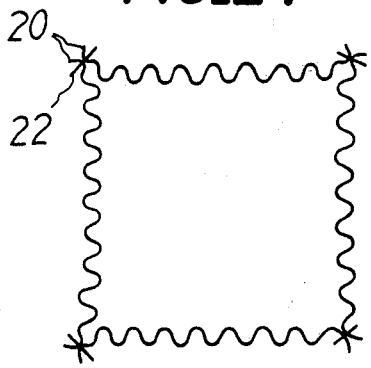
Figure 25:
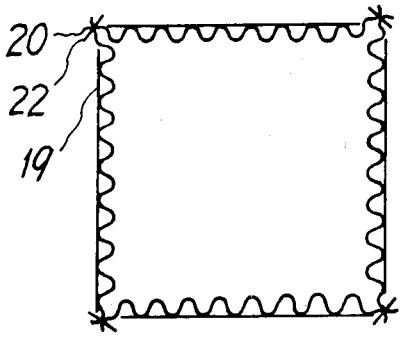
Figure 26:
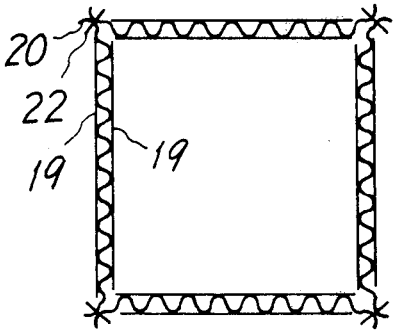

FIGS. 13 and 24 show two embodiments of the hollow long body made from a corrugated sheet 20, for the purpose of increasing the "modulus of section" values. FIGS. 14 and 25 show two embodiments of the hollow long body made from a "single-face corrugated board" obtained by combining the flat sheet 19, with the corrugated sheet 20. FIGS. 15 and 26 show two embodiments of the hollow long body made from a "double-face corrugated board" obtained by sandwiching the corrugated sheet 20, between two flat sheets 19.

Figure 16:
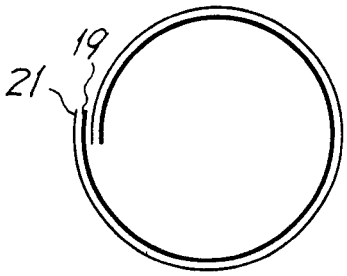
Figure 17:
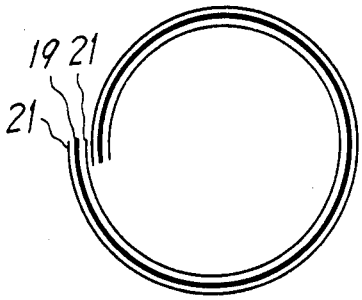
Figure 18:
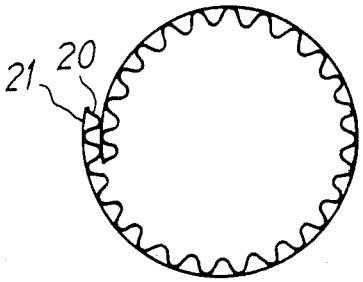
Figure 19:
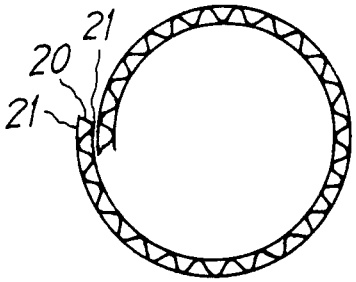
Figure 27:
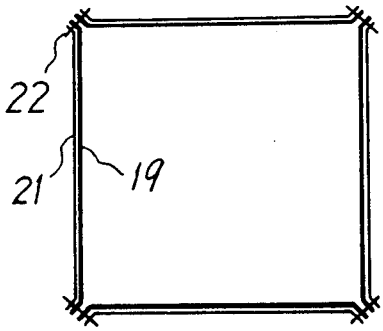
Figure 28:
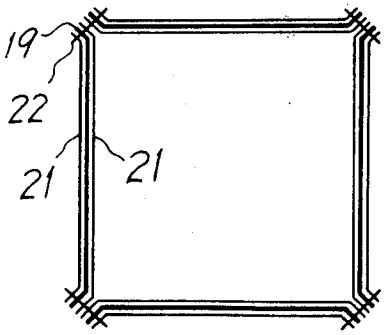
Figure 29:
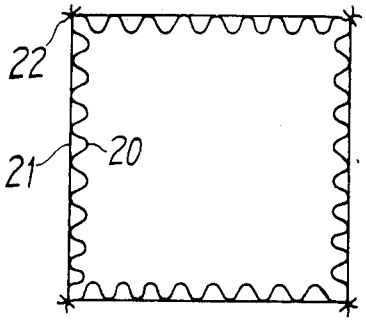
Figure 30:
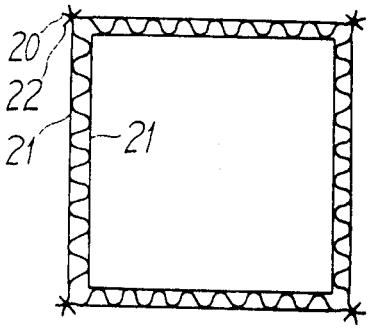
Figure 31:
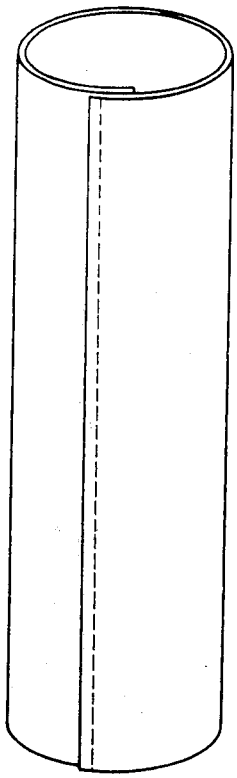
FIGS. 31 and 32 are perspective views of embodiments of hollow long bodies made from the self-fluxing heat-resistant sheets according to the present invention, respectively.
Figure 32:
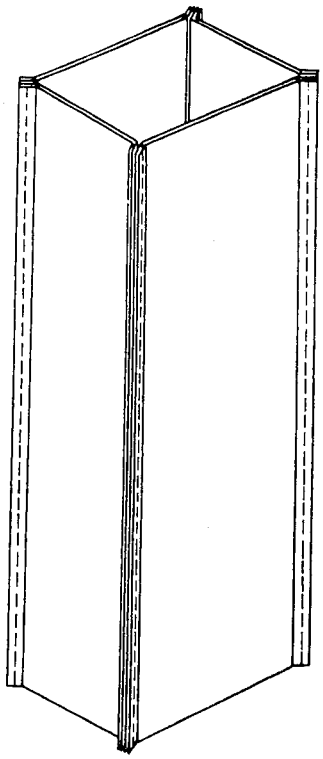

Further, the self-fluxing heat-resistant sheet can be combined with a metal foil or thin sheet of 0.02–1 mm in thickness. According to given conditions and metal grades, metals such as aluminum, mild steel, pure iron, and other non-ferrous metals and alloys can be used for this purpose. FIGS. 16 and 27 show hollow long bodies of two-layer sheet obtained by combining the metal foil or thin sheet 21 to one surface of the flat sheet 19. FIGS. 17 and 28 show hollow long bodies of three-layer sheet obtained by combining the metal foil or thin sheet 21, to both surfaces of the flat sheet 19. FIGS. 18 and 29 show hollow long bodies of "single-face corrugated board" obtained by combining the metal foil or thin sheet 21, to one side of the corrugated sheet 20. FIGS. 19 and 30 show hollow long bodies of "double-face corrugated board" obtained by combining the metal foil or thin sheet 21, to both surfaces of the corrugated sheet 20.

FIGS. 14 to 19 and FIGS. 25 to 30 are embodiments that meet the requirements for limiting the amount of the melt of thin self-fluxing heat-resistant sheet and for increasing mechanical strength of the hollow long shaped body.

When shaping the hollow long body, the mutual fixing of the sheets can be performed by using an adhesive, or by a wire-sewing machine and the like, or by wire-stitching.

The hollow long body occupying a large space is unsuitable for economical transportation and storage. Accordingly, the hollow long body is preferably shaped at the casting yard. The hollow long bodies shown in FIGS. 11 to 30 can easily be shaped at the casting yard. The hollow long body to be used in the present invention can be formed into any shape, for example, oval and the like other than the embodiments shown in FIGS. 11 to 30, if necessary.

According to the present invention, the hollow long body of the self-fluxing heat-resistant sheet having slag compositions and softening-fusion characteristics suitable for given pouring conditions can be successfully used as a splash-preventive pipe for direct pouring together with a casting powder. Thus, any kind of the ferrous and non-ferrous metals can be successfully cast by direct pouring with lower ingot-making cost and higher product yield. The ingots, thus obtained, can be provided with such superior surface quality as of bottom poured ingots. Moreover, in some cases, automatic sequence direct pouring becomes applicable.

The self-fluxing heat-resistant sheet according to the present invention has heat-resisting properties for temperatures of higher than 800° C, and is easily fused and consumed at temperatures exceeding the fusion temperature. The sheet, therefore, can be used not only for direct pouring as a hollow long body but also for various purposes in various forms. For example, rather thick boards with thickness of 10–30 mm can be made by laminating the sheets with use of suitable refractory mortars. This can be used as the refractory lining for tundishes. Further, in bottom pouring, the sheet placed on the bottom aparture in the mold can effectively prevent occurrence of an initial jet caused in the starting period of bottom pouring.

When the self-fluxing heat-resistant sheet with rather low fusion temperatures and very low stiffness values is cut into ribbon-shape and placed into the gap between the mold wall bottom and the stool, the so-called "molten metal leakage" through the gap can be effectively prevented. Further, the thin sheet with thickness of less than 0.5 mm can be shaped into bags for packing casting powders, exothermic compounds and the like. The time required for heat-breaking of the bags can be controlled by selecting the sheet fusion temperature. Further, such sheets can shield metal splashes and heat radiation during forging, welding and the like.

In addition, the self-fluxing heat-resistant sheet according to the invention can be processed into various shapes and constructions in accordance with purposes by corrugating, combining with metal wire, net, foil and thin sheet and inpregnating with other materials and the like.

The following examples are given for explanation of the present invention and are not intended as limitations thereof.

EXAMPLE 1

Manufacture of Self-Fluxing Heat-Resistant Sheet 71 wt.% of an inorganic fiber blend consisting of 90 wt.% of ceramic fiber (high-temperature-fusible fiber) and 10 wt.% of rock wool (medium-temperature-fusible fiber) and 4 wt.% of a PVA binder were mixed and dispersed into water by a pulper, and formed into a sheet by a cylindrical-net-type paper-machine. This sheet was immersed in a suspension containing silica flour and sodium silicate and impregnated with 21 wt.% of silica flour and 4 wt.% of sodium silicate. Thus, the self-fluxing heat-resistant sheet with thickness of 1 mm was manufactured. The major mechanical properties of this self-fluxing heat-resistant sheet are shown in Table 1 as Sheet No. 2.

In the same manner as the above, self-fluxing heat-resistant sheets with various blended composition shown in Table 1 are manufactured. Properties of these sheets are also summerized in Table 1.

Table 1

| | Sheet No. | 1 | 2 | 3 | 4 | 5 | 6 | 7 | 8 | 9 | 10 | 11 | 12 |
|---|---|---|---|---|---|---|---|---|---|---|---|---|---|
| Inorganic fiber: | % | 71 | 71 | 71 | 71 | 71 | 82 | 80 | 65 | 71 | 71 | 67 | 72 |
| Blended Composition: High-temperature-fusible fiber | % | 100 | 90 | 75 | 55 | 0 | 0 | 0 | 75 | 75 | 55 | 75 | 0 |
| Blended Composition: Medium-temperature-fusible fiber | % | 0 | 10 | 20 | 40 | 100 | 50 | 50 | 20 | 20 | 40 | 20 | 50 |
| Blended Composition: Low-temperature-fusible fiber | % | 0 | 0 | 5 | 5 | 0 | 50 | 50 | 5 | 5 | 5 | 5 | 50 |
| Blended Composition: Binder | % | 4 | 4 | 4 | 4 | 4 | 5 | 5 | 3 | 4 | 4 | 3 | 2 |
| Blended Composition: Filler and Impregnant: Silicate | % | 21 | 21 | 21 | 21 | 21 | 13 | 13 | 29 | 21 | 21 | 20 | 22 |
| Blended Composition: Filler and Impregnant: Alkali salt | % | 4 | 4 | 4 | 4 | 4 | 0 | 0 | 3 | 4 | 4 | 3 | 4 |

Table 1-continued

| | Sheet No. | 1 | 2 | 3 | 4 | 5 | 6 | 7 | 8 | 9 | 10 | 11 | 12 |
|---|---|---|---|---|---|---|---|---|---|---|---|---|---|
| Natural or synthetic organic fiber | % | 0 | 0 | 0 | 0 | 0 | 0 | 0 | 0 | 0 | 0 | 7 | 0 |
| Carbonaceous substance | % | 0 | 0 | 0 | 0 | 0 | 0 | 2 | 0 | 0 | 0 | 0 | 0 |
| Unit weight | g/m² | 449 | 450 | 445 | 451 | 452 | 443 | 445 | 458 | 910 | 908 | 383 | 451 |
| Thickness | mm | 1.00 | 1.00 | 1.00 | 1.01 | 1.00 | 1.01 | 1.00 | 1.01 | 2.01 | 2.00 | 1.01 | 1.01 |
| Density | g/cm³ | 0.45 | 0.45 | 0.44 | 0.45 | 0.45 | 0.44 | 0.45 | 0.46 | 0.45 | 0.45 | 0.38 | 0.45 |
| Tensile strength* | | | | | | | | | | | | | |
| Mechanical Properties: temperature | g/mm² | 225 | 220 | 260 | 288 | 36 | 320 | 345 | 225 | 319 | 321 | 335 | 160 |
| Mechanical Properties: 800° C | g/mm² | 198 | 180 | 124 | 40 | 20 | 20 | 25 | 139 | 200 | 130 | 25 | 20 |
| Mechanical Properties: 900° C | g/mm² | 170 | 161 | 116 | 20 | — | — | — | 122 | 171 | 111 | — | — |
| Mechanical Properties: 1000° C | g/mm² | 97 | 90 | 76 | — | — | — | — | 85 | 99 | 70 | — | — |
| Stiffness | g*cm | 296 | 295 | 305 | 300 | 292 | 291 | 280 | 394 | 1520 | 1600 | 270 | 280 |
| Softening temperature | ° C | 1420 | 1400 | 1380 | 1030 | 1040 | 930 | 1030 | 1380 | 1400 | 1050 | 1030 | 1000 |
| Fusion temperature | ° C | 1480 | 1470 | 1450 | 1250 | 1230 | 1020 | 1120 | 1450 | 1450 | 1250 | 1250 | 1090 |
| Softening time (1100° C)** | sec | >300 | >300 | >300 | 40 | >300 | 8 | 35 | >300 | >300 | 250 | 80 | 9 |
| Fusion time (1100° C)** | sec | >300 | >300 | >300 | 210 | >300 | 55 | 195 | >300 | >300 | >300 | >300 | 58 |
| Ignition loss | % | 4.01 | 4.03 | 4.01 | 4.05 | 4.01 | 4.98 | 6.53 | 2.98 | 4.00 | 4.00 | 10.1 | 1.98 |

Note)
Glass fiber as a low-temperature-fusible fiber, wood fiber as a natural or synthetic organic fiber, and carbon black as a carbonaceous substance were used.
*: Longitudinal tensile strength of the sheet was measured according to TAPPI T-104 method.
**:"Softening time" or "Fusion time" show the respective time required for softening or fusion of the test cone in the so-called "Cone Test".

EXAMPLE 2

This example shows the variations of tensile strength of the final sheet in various adding methods of a silicate filler to the sheet made from inorganic fibers and a binder.

71 wt.% of an inorganic fiber blend consisting of 75 wt.% of ceramic fiber, 20 wt.% of slag wool and 5 wt.% of glass fiber, and 4 wt.% of a PVA binder were mixed and dispersed into water by a pulper, and formed into a sheet by a cylindrical-net-type paper-machine. To this sheet, silica flour was added by a spraying method, an immersing method and a coating method to be impregnated with 25 wt.% of the silicate filler therein. Tensile strength (g/mm²) of the final self-fluxing heat-resistant sheet was measured according to TAPPI T-104 method and the results thereof are shown in Table 2.

Table 2

| | Spraying method (g/mm²) | Immersing method (g/mm²) | Coating method (g/mm²) |
|---|---|---|---|
| Room temperature | 160 | 240 | 200 |
| 800° C | 60 | 120 | 80 |
| 900° C | 40 | 80 | 40 |

As is obvious from Table 2, the silicate filler must preferably be added to the sheet by an immersing method, i.e. by immersing the sheet in a suspension of filler.

Example 3

This example shows that the combined use of a metal net or a thin metal sheet with the self-fluxing heat-resistant sheet increases the mechanical strength of the resultant sheet.

The two kinds of combined sheet were made from "Sheet No. 3" in Table 1, one was embedded with a metal net therein and another was combined with a thin metal sheet thereon. Tensile strength (g/mm²) of the original No. 3 sheet and the two combined sheets were measured and summarized in Table 3.

Table 3

| | Original Sheet No. 3 (g/mm²) | Sheet with metal net (g/mm²) | Sheet with combined thin metal sheet (g/mm²) |
|---|---|---|---|
| Room temperature | 260 | >400 | >600 |
| 800° C | 120 | >400 | >400 |
| 900° C | 80 | >200 | >280 |

Example 4

A. Manufacture of Hollow Long Body

The self-fluxing heat-resistant sheet No. 3 in Table 1 was shaped into four types of hollow cylindrical bodies with the same inner diameter of 200 mm. In shaping, the lapped portions of flat sheets or corrugated sheets with combined metal foil were joined by wire-stitching.

Construction of the shaped bodies is as follows:

Test cylinder No. 1:
with single layer flat sheet construction
Test cylinder No. 2:
with double layer flat sheet construction
Test cylinder No. 3:
with triple layer flat sheet construction
Test cylinder No. 4:
with combined construction of a corrugated sheet with a corrugation height of 10 mm and an iron foil with thickness of 250 micron.

B. Pouring Test

Each type of the above test cylinders was suspended in the big-end-up ingot molds of 1.3 t by fixing each cylinder top on each hot-top frame. Melts of carbon steel and low alloy steel for machine structure use were poured into the mold through the above test cylinder assemblies. These pouring tests were performed at a teeming temperature of 1,540° to 1,560° C and a teeming rate of 700 to 900 mm/min, with use of 2.5 Kg/t of the selected casting powder ("TEEMIX" made by Nippon Thermochemical Co., Ltd.). The surface and internal qualities of 35 ingots were inspected. The results obtained are shown in Table 4.

For comparison results, some ingots of the same steel grades were also made by a conventional simply direct pouring under the same conditions but without use of the casting powder. In this case, however, the mold walls were dressed by spraying hot dehydrated tar because use of the casting powder was very difficult.

Table 4

| | Surface defects | | | | Internal defects | |
|---|---|---|---|---|---|---|
| Test cylinder | scale entrapp-ments | splash-es | scaps | slag patches | pin holes | clean-liness degree |
| No. 1 | none | none | few | few | none | good |
| No. 2 | none | none | none | none | none | good |
| No. 3 | few | none | none | not so numerous | none | good |
| No. 4 | none | none | none | none | none | rather good |
| Conventional direct pouring | not so numerous | numer-ous | numer-ous | none | few | rather good |

In the above test results, cylinder No. 2 shows the best results, while cylinder No. 4 does not show any surface defects but shows a slight trace of iron foil in the cast structure. Since cylinder No. 1 is of a single layer of the flat sheet, the local fusion and disintegration of the sheet causes irregular spread of the pouring stream, resulting in the formation of a few slag patches originating from the casting powder. When the cylinder is of triple layer construction as shown in cylinder No. 3, the amount of the melt of the sheet is increased. This causes a change in molten slag properties of the casting powder and thereby, increases slag patches. Cylinder No. 4, the fusion and diffusion of the iron foil is not completed during the ingot-making process. This is because the rather small section dimensions of the mold in these tests causes rather rapid solidification of the steel. Accordingly, with respect to the mold cross-section and the amount of casting powder added, the cylinder with double layer construction produces the best results. The ingot manufactured by conventional direct pouring is far inferior in quality.

We claim:

1. A method of directly pouring molten metal into a mold to make a metal ingot comprising; fixing on the top portion of the mold a hollow long body of self-fluxing heat-resistant sheet consisting of 50–90% by weight of at least one of an inorganic fiber, 1–10% by weight of a binder and 10–50% by weight of a silicate filler suspending into the said mold to reach the mold bottom; placing a casting powder on the mold bottom outside the said hollow long body; pouring the molten metal from the mold top through the said hollow long body and controlling the softening and fusion temperatures and rates of the said hollow long body so as to be fused and consumed under such conditions that the bottom end of the said hollow long body is constantly submerged into a given depth below the molten metal surface, with rise of the said molten metal surface in the said mold, wherein said inorganic fibers are selected from the three groups consisting of ceramic fiber, silicate fiber, boron fiber and carbon fiber with fusion temperatures greater than 1,300° C; of rock wool and slag wool with fusion temperatures of 1,100° – 1,300° C; and of glass fiber and asbestos fiber with fusion temperatures of 800°–1,100° C; and blended so as to provide the blend with fusion temperatures of greater than 800° C and said self-fluxing heat-resistant sheet has a thickness of 0.2–5mm.

2. A method as claimed in claim 1, wherein said binder is selected from starch, PVA resin, acrylic resin, epoxy resin, urea resin, phenolic resin and vinyl acetate resin.

3. A method as claimed in claim 1, wherein said silicate filler is selected from silica flour, kaolin, bentonite, refractory clay and calcium silicate.

4. A method as claimed in claim 1, wherein said self-fluxing heat-resistant sheet is made by forming a mixture of the inorganic fibers and the binder into a sheet and then impregnating said sheet with the silicate filler by spraying a suspension of the filler to the formed sheet, by immersing the sheet in the suspension or by coating the sheet with a thickened suspension.

5. A method as claimed in claim 1, wherein said self-fluxing heat-resistant sheet has a thickness of 0.5–1.2 mm.

6. A method as claimed in claim 1, wherein said inorganic fiber is blended with up to 30% by weight of a natural or synthetic organic fiber.

7. A method as claimed in claim 6, wherein said natural fiber is selected from wood fiber, cotton fiber and cotton yarn.

8. A method as claimed in claim 6, wherein said synthetic organic fiber is selected from polyethylene fiber, polypropylene fiber, vinylon fiber, nylon fiber, acrylic fiber, polyester fiber and rayon fiber.

9. A method as claimed in claim 6, wherein said blend of inorganic fiber and natural or synthetic organic fiber is additionally mixed with a metallic fiber of iron, aluminum, stainless steel and copper.

10. A method as claimed in claim 1, wherein said silicate filler is mixed with up to 10% by weight of an impregnant.

11. A method as claimed in claim 10, wherein said impregnant is selected from the three groups; salts of sodium, potassium, magnesium and barium; oxides of magnesium and titanium; and phosphates.

12. A method as claimed in claim 10, wherein to said silicate filler, is added powder of aluminum, ferrosilicon, calcium silicon, magnesium or ferromanganese as a deoxidizer.

13. A method as claimed in claim 1, wherein said self-fluxing heat-resistant sheet is impregnated with a carbonaceous substance.

14. A method as claimed in claim 13, wherein said carbonaceous substance is selected from carbon black, tar and asphalt.

15. A method as claimed in claim 1, wherein said hollow long body is composed of a flat sheet of self-fluxing heat-resistant sheet.

16. A method as claimed in claim 1, wherein said hollow long body is shaped by lap-winding a flat sheet of self-fluxing heat-resistant sheet.

17. A method as claimed in claim 1, wherein said hollow long body is shaped by lapping the flat self-fluxing heat-resistant sheets with each other.

18. A method as claimed in claim 17, wherein the lap number of the said sheets is at most 3.

19. A method as claimed in claim 1, wherein said hollow long body is composed of a corrugated sheet of self-fluxing heat-resistant sheet.

20. A method as claimed in claim 1, wherein said hollow long body is composed by combining a corrugated sheet on one surface of a flat sheet of self-fluxing heat-resistant sheet.

21. A method as claimed in claim 1, wherein said hollow long body is composed by sandwiching a corrugated sheet between two flat self-fluxing heat-resistant sheets.

22. A method as claimed in claim 1, wherein said hollow long body is composed by combining a thin metal sheet of 0.02–1 mm thickness on one or both surfaces of a flat self-fluxing heat-resistant sheet.

23. A method as claimed in claim 22, wherein said thin metal sheet is selected from aluminum, mild steel, pure iron, non-ferrous metal and alloy thereof.

24. A method as claimed in claim 1, wherein said hollow long body is composed by combining a thin metal sheet of 0.02–1 mm thickness on one or both sides of a corrugated sheet of self-fluxing heat-resistant sheet.

25. A method as claimed in claim 24, wherein said thin metal sheet is selected from aluminum, mild steel, pure iron, non-ferrous metal and alloy thereof.

* * * * *